US005092711A

United States Patent [19]

Langner

[11] Patent Number: 5,092,711

[45] Date of Patent: Mar. 3, 1992

[54] DIVERLESS INSTALLATION OF RISER CLAMPS ONTO FIXED OR COMPLIANT OFFSHORE PLATFORMS

[75] Inventor: Carl G. Langner, Spring, Tex.

[73] Assignee: Shell Oil Company, Houston, Tex.

[21] Appl. No.: 226,243

[22] Filed: Jul. 29, 1988

[51] Int. Cl.[5] ..... E02B 17/00

[52] U.S. Cl. ..... 405/169; 405/191; 405/195.1; 166/341; 166/345; 166/359; 248/316.1

[58] Field of Search ..... 405/169, 191, 195; 166/341, 344, 345, 351, 359, 367; 248/316.8, 316.1; 24/136 R, 132 WL

[56] References Cited

U.S. PATENT DOCUMENTS 3,739,592 6/1973 Plake ..... 166/359 X
4,116,015 9/1978 Duncan ..... 405/169
4,386,659 6/1983 Shotbolt ..... 166/344 X
4,423,982 1/1984 Zaremba ..... 166/367 X
4,661,017 4/1987 Wood et al. ..... 405/169

*Primary Examiner*—Randolph A. Reese
*Assistant Examiner*—Arlen L. Olsen

[57] ABSTRACT

Riser clamps are installed onto fixed or compliant offshore platforms by a diverless technique. Each riser clamp is rigidly or hingedly attached to a heavy tapered wedge. Mating tapered receptacles are built into the platform, preferably at various levels along a corner leg. Only one lift line is utilized which may be either a drill string or wire rope, and one remotely operated vehicle (ROV) for observation, to lower and stab each riser clamp into one of the tapered receptacles on the platform.

1 Claim, 2 Drawing Sheets

FIG. 1
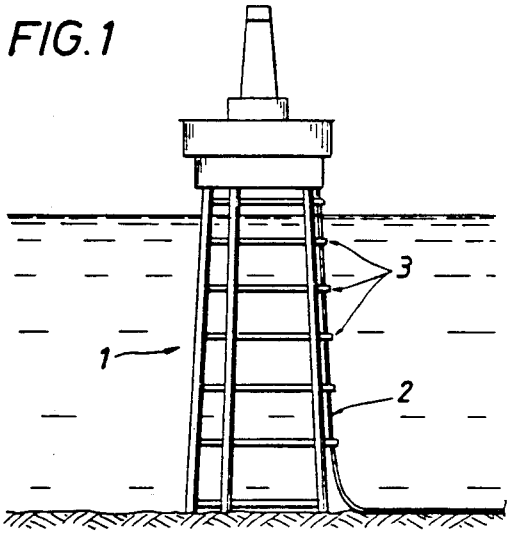
FIG. 2
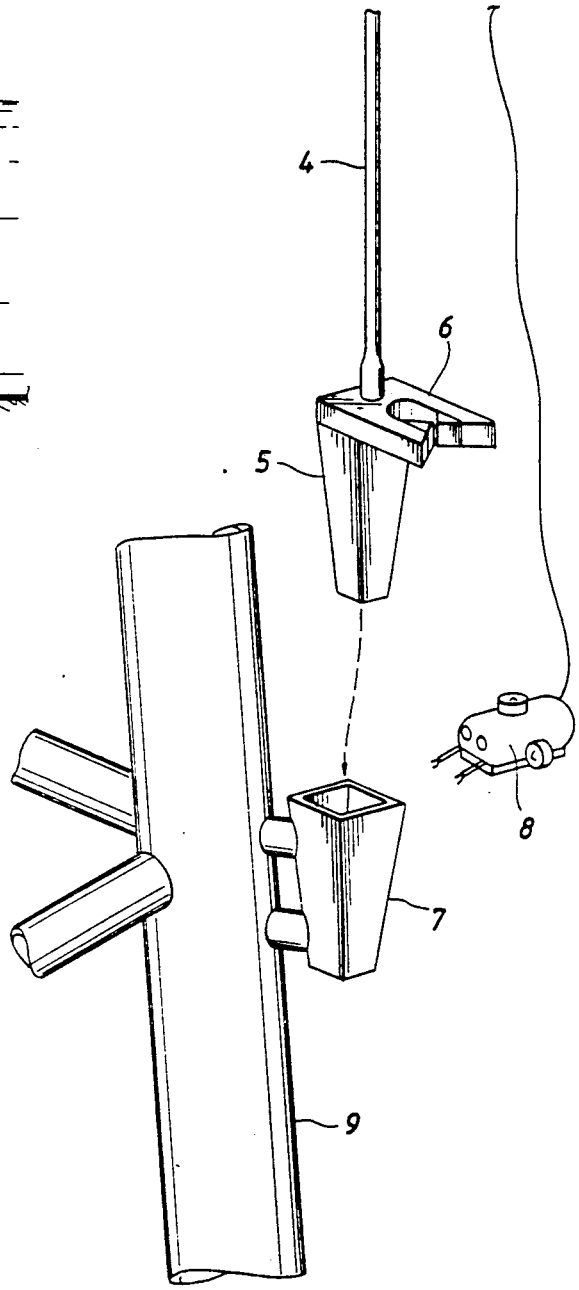
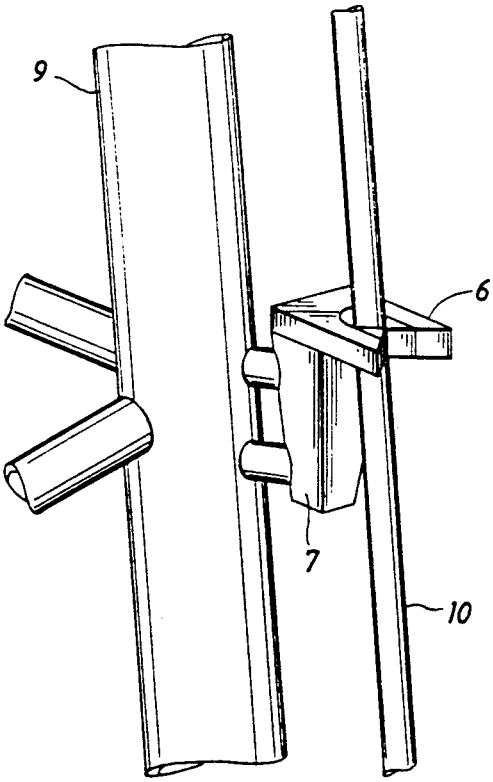
FIG. 3

FIG. 4
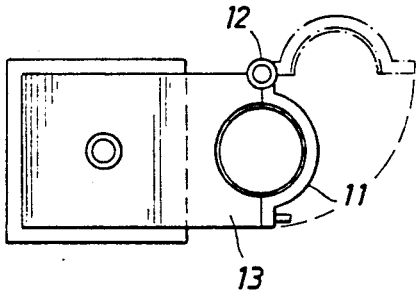
FIG. 5
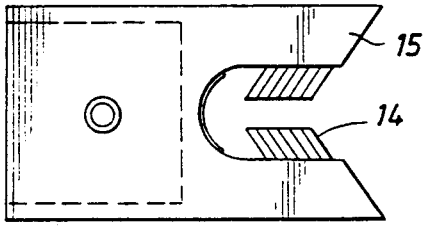
FIG. 6
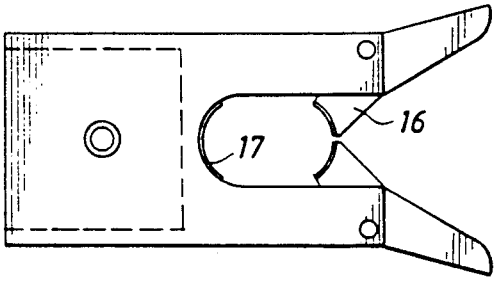
FIG. 7
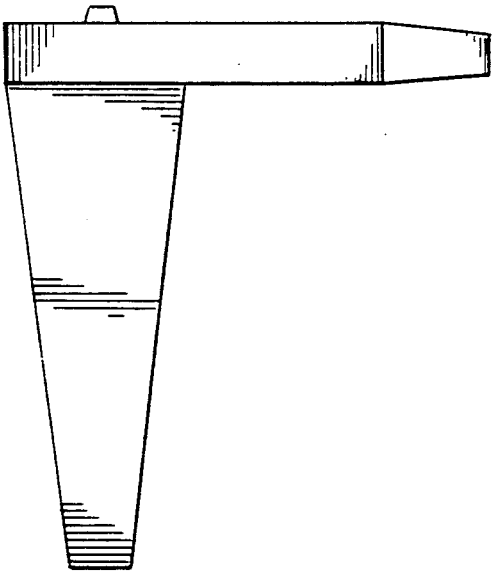
FIG. 8
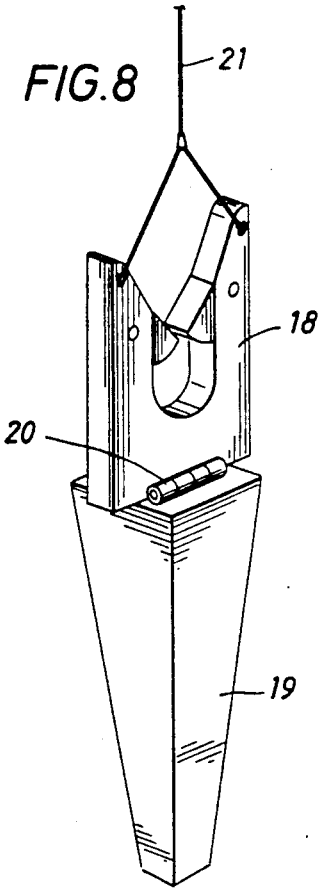
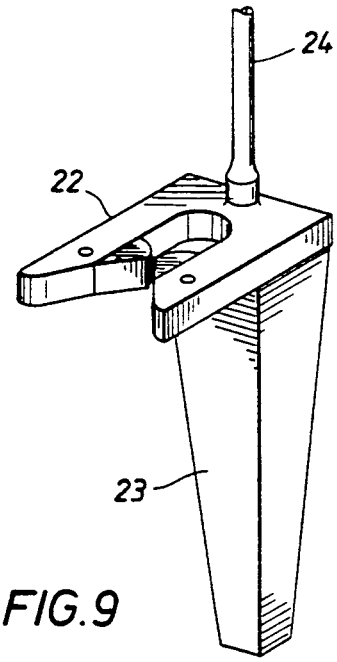
FIG. 9

DIVERLESS INSTALLATION OF RISER CLAMPS ONTO FIXED OR COMPLIANT OFFSHORE PLATFORMS

BACKGROUND OF THE INVENTION

The installation of risers on offshore platforms and the like is a difficult and time-consuming problem requiring first the installation of riser clamps to which the risers are attached. The current state of the art requires the laborious installation of such riser clamps by divers. Each clamp is guided into position while suspended from the surface; then a strap attached to the clamp is passed around the platform leg; finally the clamp is secured to the platform leg by bolting the strap in place. The present invention is directed to overcoming this problem of the art by providing a method and apparatus or the diverless installation of riser clamps.

Applicant is not aware of any prior art which, in his judgment as one skilled in the art to which the present invention pertains, would anticipate or render obvious the novel technique of the invention.

SUMMARY OF THE INVENTION

The primary purpose of the present invention is to provide a method and apparatus by which riser clamps may be installed onto fixed and compliant offshore platforms without the use of divers or Substantially without the use of divers. Accordingly, a process is provided for installing a riser camp on an offshore structure comprising: providing at least one clamp receptacle attached to the offshore structure, e.g. at an underwater location; and lowering a clamp anchor into said clamp receptacle, said clamp anchor having an affixed riser clamp. The present invention also provides an apparatus !or installing a riser clamp on an offshore structure comprising: at least one riser clamp receptacle attachable to the offshore structure, e.g. at an underwater location; and means for lowering a camp anchor into said clamp receptacle, said clamp anchor having an affixed riser clamp. Preferably, the clamp anchor and clamp receptacle are wedge shaped so that the clamp anchor is easily guided into the clamp receptacle. More preferably, the present invention includes automatic clamps capable of capturing the riser by deformable bristles or vanes or by spring-loaded trap doors.

Other purposes, distinctions over the art, advantages and features of the invention will be apparent to one skilled in the art upon review of the following.

BRIEF DESCRIPTION OF THE DRAWINGS

FIG. 1 shows an offshore platform with an externally clamped-on pipeline riser.

FIG. 2 depicts lowering and landing a riser clamp wedge into a wedge-shaped receptacle.

FIG. 3 discloses a pipeline riser installed in a diverless riser clamp.

FIGS. 4 through 9 show various configurations of riser clamps and stab-in wedges.

FIG. 4 is a top view of a conventional hinged/bolted split clamp.

FIG. 5 is a top view of an automatic clamp with a riser captured by deformable bristles or vanes.

FIG. 6 is a top view of another automatic clamp with a riser captured by spring-loaded trap doors.

FIG. 7 is a side view of a riser clamp and wedge.

FIG. 8 shows a riser clamp attached via a hinge to a wedge to be lowered on a wire rope.

FIG. 9 depicts a riser clamp rigidly affixed to a wedge to be lowered on a drill pipe.

DESCRIPTION OF PREFERRED EMBODIMENTS

The present invention provides a method and apparatus for simply and economically installing riser clamps onto fixed or compliant (e.g., bottom founded) offshore platforms. Once installed, these clamps may be used to receive, for example, a barefoot riser or other external vertical riser such as connected to a pipeline by a spool piece, etc.

Each riser clamp preferably is rigidly or hingedly attached to an anchor, preferably a heavy tapered wedge, which may be for example a steel shell filed with concrete. Receptacles, preferably mating tapered receptacles, are built into the platform, preferably at various levels along a corner leg, as shown in the figures of the drawing and described hereinafter.

The method of the invention preferably uses only one lift line, which may be either a drill string or a wire rope, and preferably a remotely operated vehicle (ROV) for observation, when the camp receptacle is underwater, to lower and stab each riser clamp into one of the receptacles on the platform, thus avoiding, or at least substantially avoiding, the high cost of deep sea diving to install the clamps.

Advantages of the present invention include: (1) the method is adaptable to a variety of clamp designs and sizes, (2) the decision as to size and/or placement of the pipeline riser can be delayed until after the platform is installed and until shortly before the riser itself is installed; (3) the mechanical parts of the riser clamps need not be subjected to corrosion deterioration or marine growth during the time period between platform installation and riser installation.

Having thus generally described the apparatus and method of the invention, as well as its numerous advantages over the art, the following is a more detailed description thereof, given in accordance with specific reference to the drawings.

Offshore platform 1 shown in FIG. 1 has a pipeline riser 2 connected thereto by means of underwater riser clamps 3. Some of the riser clamps may be above water. FIG. 2 shows the details of lowering and landing a riser clamp wedge into a wedge-shaped receptacle. A lifting line 4 is attached to a clamp wedge or anchor 5 to which is attached a riser clamp 6. This is lowered into a camp receptacle 7 during observation, preferably by an ROV 8. The clamp receptacle 7 is preferably attached to a corner platform leg 9 which forms a part of the offshore platform as shown in FIG. 1.

FIG. 3 shows the pipeline riser 10 locked in place in the riser clamp 6 which in turn is attached by means of the clamp receptacle 7 to platform leg 9.

Various configurations of riser clamps and stab-in wedges or anchors are shown in FIGS. 4 through 9. In FIG. 4 a top view is shown of a conventional hinged/-bolted split clamp, hinge 11 being functional to rotate about bolt 12 to lock riser 10 into place inside clamp 13. In FIG. 5, a top view is shown of an automatic clamp, the riser being captured by deformable bristles or vanes 14 within clamp 15. In FIG. 6 there is shown a top view of another automatic clamp with the riser being captured by spring-loaded trap doors 16 and a movable rear dog 17.

In FIG. 7, a side view of the riser clamp and wedge or anchor is provided. The wedge or anchor cross section is preferably either triangular or rectangular. Either shape facilitates landing the riser clamp wedge or anchor into the receptacle shown in FIGS. 2 and 3.

In FIG. 8 a riser clamp 18 is attached to a wedge or anchor 19 by means of hinge 20, all of which are lowered by means of a wire rope 21. In FIG. 9 a riser clamp 22 attached to wedge or anchor 23 is lowered at the end of a drill pipe 24. Manifestly, various other lowering means may be employed to lower the wedge and riser clamp into place.

The foregoing description of the invention is merely intended to be explanatory thereof, and various changes in the details of the described method and apparatus may be made within the scope of the appended claims without departing from the spirit of the invention.

What is claimed is:

1. An apparatus for installing a riser clamp on an offshore structure comprising:

at least one riser clamp receptacle attachable to the offshore structure; and means for lowering a clamp anchor into said clamp receptacle, said clamp anchor having an affixed hingedly attached riser clamp.

* * * * *